US009229369B2

(12) United States Patent
Iketani

(10) Patent No.: US 9,229,369 B2
(45) Date of Patent: Jan. 5, 2016

(54) IMAGE FORMING APPARATUS

(71) Applicant: KYOCERA Document Solutions Inc., Osaka (JP)

(72) Inventor: Takeshi Iketani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/549,351

(22) Filed: Nov. 20, 2014

(65) Prior Publication Data

US 2015/0147095 A1 May 28, 2015

(30) Foreign Application Priority Data

Nov. 28, 2013 (JP) ..... 2013-245591

(51) Int. Cl.
*G03G 15/08* (2006.01)

(52) U.S. Cl.
CPC .... *G03G 15/0877* (2013.01); *G03G 2215/0692* (2013.01)

(58) Field of Classification Search
CPC ..... G03G 21/1832; G03G 2215/0668; G03G 2215/0692
See application file for complete search history.

(56) References Cited

U.S. PATENT DOCUMENTS 8,554,116 B2 * 10/2013 Sato ..... 399/258
8,737,887 B2 * 5/2014 Cavill et al. ..... 399/260

FOREIGN PATENT DOCUMENTS

JP 2008-116479 A 5/2008
JP 2013250364 A * 12/2013

OTHER PUBLICATIONS

Machine translation of JP 2013-250364 A obtained on May 21, 2015.*

* cited by examiner

*Primary Examiner* — Gregory H Curran
(74) *Attorney, Agent, or Firm* — Studebaker & Brackett PC

(57) ABSTRACT

An image forming apparatus includes a toner case, an apparatus main body and a cover. The toner case includes a case main body, a shutter and a manipulation portion. The case main body has a discharge port configured to discharge a toner. The shutter opens/closes the discharge port. The manipulation portion is movable between a first position to make the shutter open the discharge port and a second position to make the shutter close the discharge port. To the apparatus main body, the toner case is detachably attached. The cover is openably/closably attached to the apparatus main body. The cover includes an interfering member. The interfering member is movable between an interfering position where the interfering member interferes with the manipulation portion being in the second position and an interference release position where the interfering member does not interfere with the manipulation portion being in the second position.

10 Claims, 18 Drawing Sheets

IMAGE FORMING APPARATUS

INCORPORATION BY REFERENCE

This application is based on and claims the benefit of priority from Japanese Patent application No. 2013-245591 filed on Nov. 28, 2013, the entire contents of which are incorporated herein by reference.

BACKGROUND

The present disclosure relates to an electrographic image forming apparatus.

Conventionally, an electrographic image forming apparatus carries out development process by supplying a toner (a developer) from a development device to an electrostatic latent image formed on a surface of a photosensitive drum or the like. The toner used in the development process is supplied from a toner case to the development device.

The above-mentioned toner case includes, for example, a case main body having a discharge port configured to discharge the toner and a shutter configured to open/close the discharge port. In the image forming apparatus including the toner case with such a configuration, there is a possibility that a cover covering the toner case is closed by erroneous operation of a worker (e.g. a user) in a situation where the shutter closes the discharge port. If such a circumstance occurs, there is a possibility of causing a trouble that image forming operation cannot be started despite the fact that the case main body contains the toner. Thereupon, there is a configuration that a manipulation portion connected to the shutter interferes with the cover so that the cover is not closed in the situation where the shutter closes the discharge port.

When the image forming apparatus is shipped, the shutter closes the discharge port in order to prevent the toner from leaking from the case main body in transit. In the above-mentioned configuration, if the toner case is installed to an apparatus main body in the situation where the shutter closes the discharge port, because the cover becomes unclosable, it is difficult to ship the image forming apparatus in a situation where the toner case is installed to the apparatus main body. Therefore, the toner case is packed separately from the apparatus main body, and accordingly, the volume and the number of the packing materials are increased and increase of a packing cost is caused.

SUMMARY

In accordance with an embodiment of the present disclosure, an image forming apparatus includes a toner case, an apparatus main body and a cover. The toner case includes a case main body, a shutter and a manipulation portion. The case main body has a discharge port configured to discharge a toner. The shutter is configured to open/close the discharge port. The manipulation portion is movable between a first position to make the shutter open the discharge port and a second position to make the shutter close the discharge port. To the apparatus main body, the toner case is detachably attached. The cover is openably/closably attached to the apparatus main body. The cover includes an interfering member. The interfering member is movable between an interfering position where the interfering member interferes with the manipulation portion being in the second position and an interference release position where the interfering member does not interfere with the manipulation portion being in the second position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
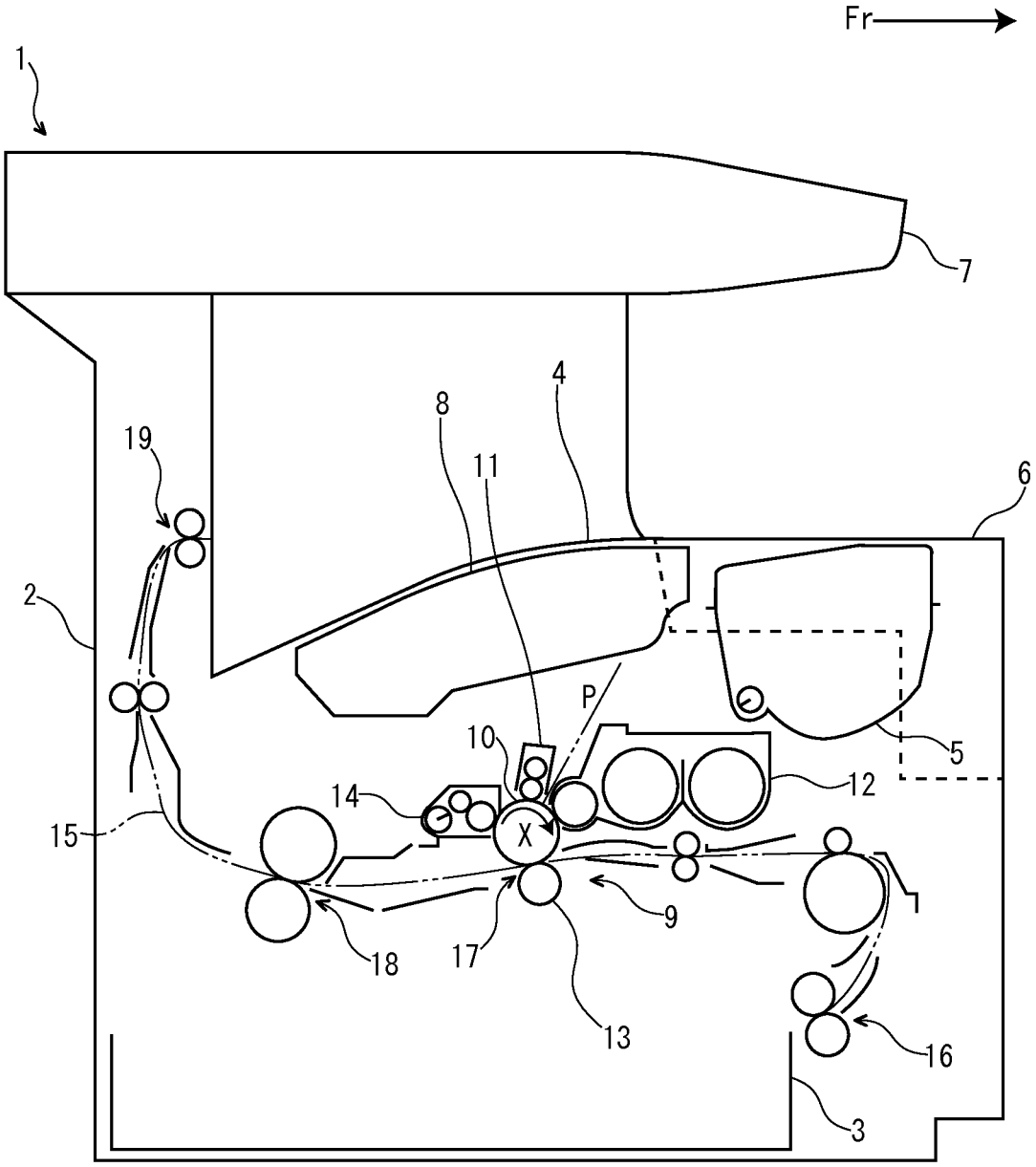
FIG. 1 is a schematic diagram schematically showing a printer according to an embodiment of the present disclosure.

First, with reference to FIG. 1, the entire structure of an electrographic printer (an image forming apparatus) 1 will be described. An arrow Fr in FIG. 1 indicates the front side of the printer 1 (FIG. 2 and other figures have the similar arrows).

The printer 1 includes a box-formed printer main body 2 (an apparatus main body). To a lower portion of the printer main body 2, a sheet feeding cartridge 3 storing sheets (not shown) is installed and, in a center portion in upward and downward directions of the printer main body 2, an ejected sheet tray 4 is arranged. In a front portion of the printer main body 2, a toner container 5 (a toner case) is installed and, to a front upper portion of the toner container 5, a front cover 6 (a cover) is attached. In an upper end portion of the printer main body 2, an image reading device 7 is provided.

In the printer main body 2, an exposure device 8 composed of a laser scanning unit (LSU) is located below the ejected sheet tray 4. Below the exposure device 8, an image forming portion 9 is provided. To the image forming portion 9, a photosensitive drum 10 as an image carrier is rotatably installed. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a sheet conveying path 15 is arranged. At an upstream end of the conveying path 15, a sheet feeding portion 16 is positioned. At an intermediate stream portion of the conveying path 15, a transferring portion 17 constructed of the photosensitive drum 10 and transfer roller 13 is positioned. At a downstream portion of the conveying path 15, a fixing device 18 is positioned. At a downstream end of the conveying path 15, a sheet ejecting portion 19 is positioned.

Next, image forming operation of the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, the image forming operation is carried out as follows.

First, a surface of the photosensitive drum 10 is electrically charged by the charger 11. Then, exposure corresponding to the image data is carried out onto the photosensitive drum 10 by a laser (refer to two-dot chain line P in FIG. 1) from the exposure device 8, thereby forming an electrostatic latent image on the surface of the photosensitive drum 10. Subsequently, the electrostatic latent image is developed to a toner image with a toner (a developer) in the development device 12.

On the other hand, the sheet picked up from the sheet feeding cartridge 3 by the sheet feeding portion 16 is conveyed to the transferring portion 17 in a suitable timing for the above-mentioned image forming operation, and then, the toner image on the photosensitive drum 10 is transferred onto the sheet in the transferring portion 17. The sheet with the transferred toner image is conveyed to the downstream side on the conveying path 15 to be inserted to the fixing device 18, and then, the toner image is fixed on the sheet in the fixing device 18. The sheet with the fixed toner image is ejected from the sheet ejecting portion 20 to the ejected sheet tray 4. The toner remained on the photosensitive drum 10 is collected by the cleaning device 14.

Next, the printer main body 2 will be described.

Figure 3:
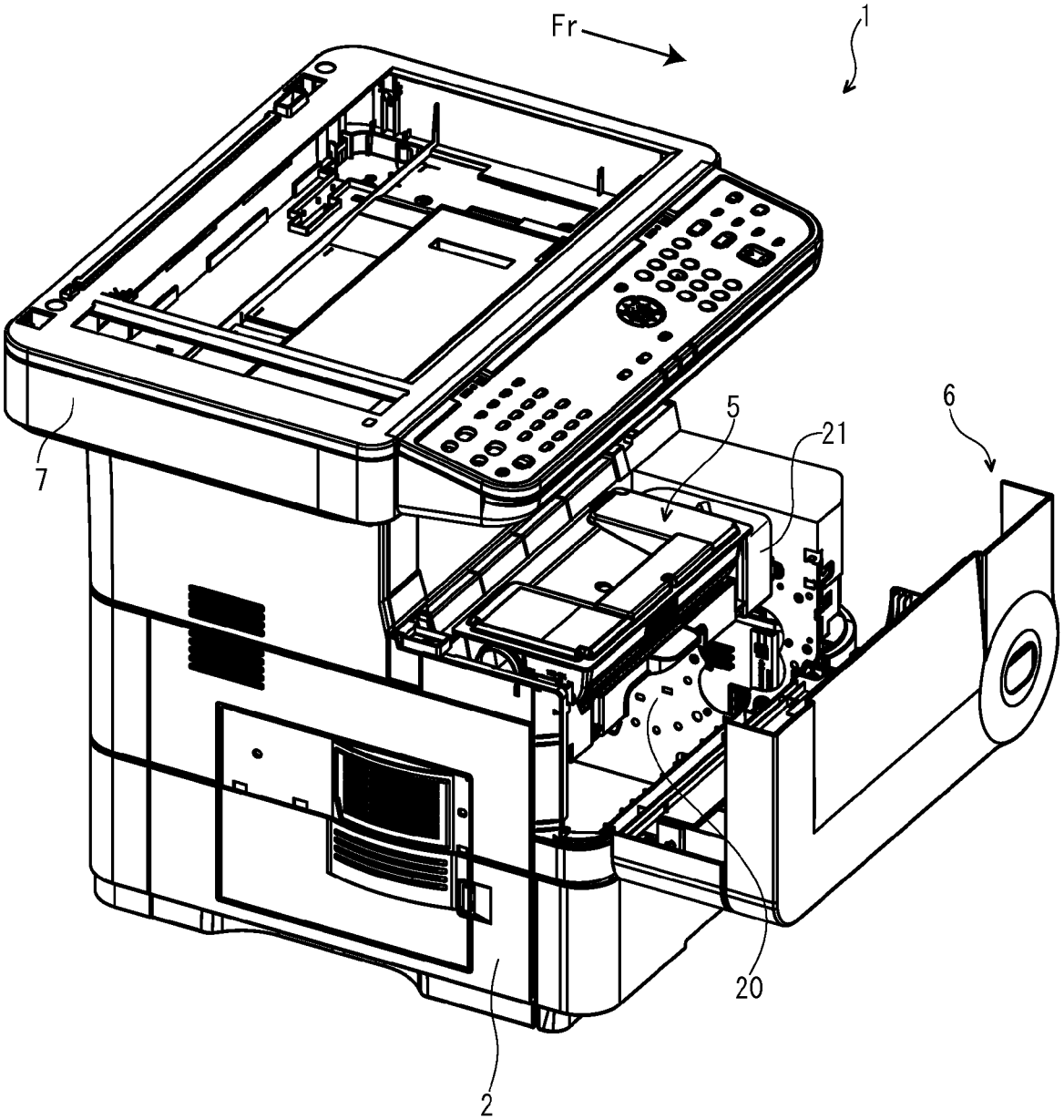
FIG. 3 is a perspective view showing the printer, in a situation where the front cover is opened, according to the embodiment of the present disclosure.

As shown in FIG. 3, in the printer main body 2, a container installation portion 20 is arranged at a portion covered by the front cover 6. At a right end side of the container installation portion 20, a case member 21 is provided. In the case member 21, a drive mechanism (not shown) having a drive source, such as a motor, is housed.

Next, the toner container 5 will be described.

Figure 4:
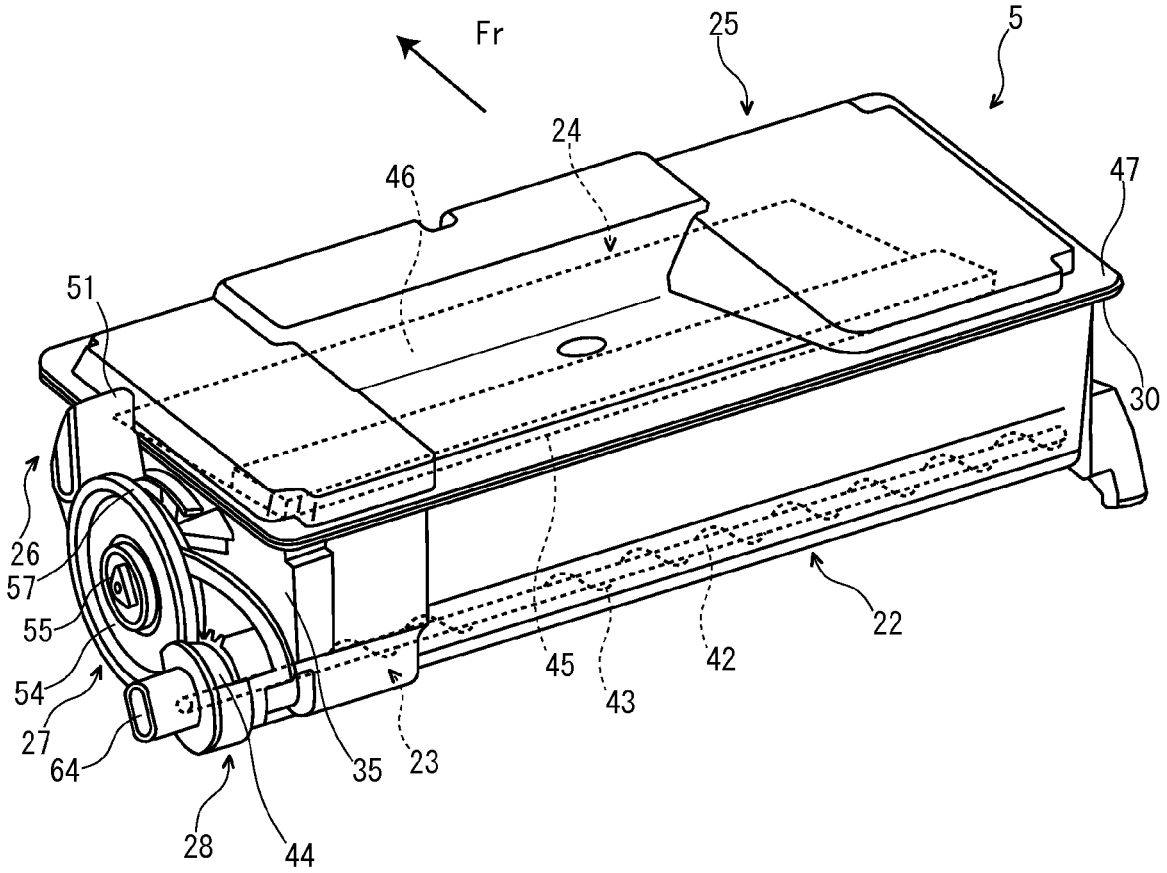
FIG. 4 is a perspective view showing a toner container of the printer according to the embodiment of the present disclosure.

As shown in FIG. 3, the toner container 5 is detachably attached to the container installation portion 20 of the printer main body 2. As shown in FIG. 4, the toner container 5 includes a box-formed case main body 22 with an opened upper face, a conveying screw 23, an agitating paddle 24, a covering body 25, a lever 26 (a manipulation portion), a transmitting member 27 and a shutter 28. The conveying screw 23 is installed to a rear lower portion of the case main body 22. The agitating paddle 24 is installed near a center portion of the case main body 22. The covering body 25 covers the upper face of the case main body 22. The lever 26 is attached to a right end portion of the case main body 22. The transmitting member 27 is located on the right end portion of the case main body 22 together with the lever 26. The shutter 28 is attached to a rear lower side of the right end portion of the case main body 22.

Figure 5:
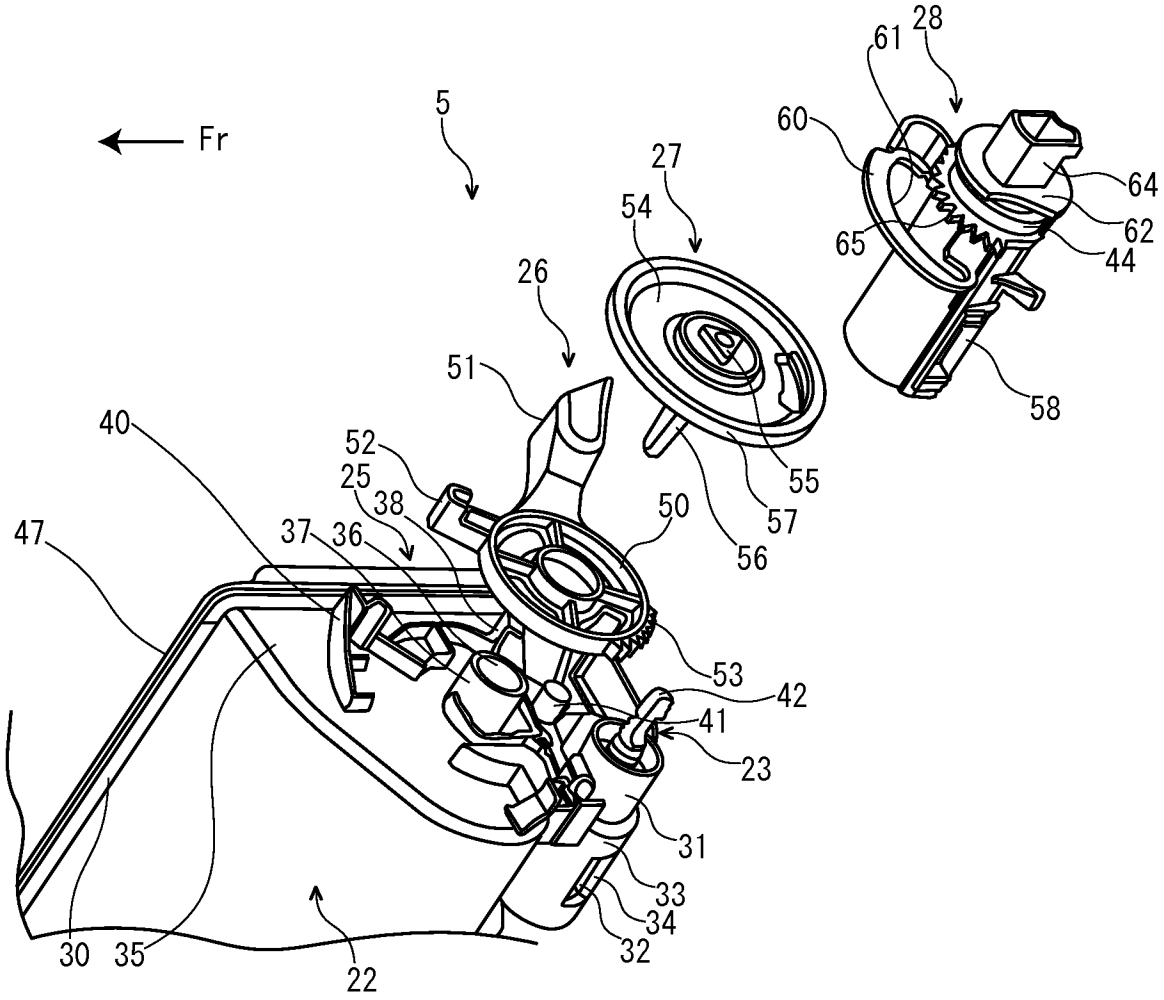
FIG. 5 is an exploded perspective view showing the toner container in the printer according to the embodiment of the present disclosure.

The case main body 22 is formed in an elongated-shape in left and right directions to contain the toner. On an outer circumference of an upper end of the case main body 22, a main body side flange portion 30 is formed. As shown in FIG. 5, at a right lower end portion of the case main body 22, a cylindrical discharge duct 31 is protruded to a right direction and, in a bottom portion of the discharge duct 31, a discharge port 32 configured to discharge the toner is bored. On an outer circumference of a lower portion of the discharge duct 31, a sealing member 33 is attached and, in the sealing member 33, a communication port 34 is bored at a correspondent position to the discharge port 32.

At the center of a right end wall 35 of the case main body 22, a cylindrical boss 37 having a communication hole 36 is protruded to the right direction (an outside direction). On a right face (an outer face) of the right end wall 35 of the case main body 22, a first restriction rib 38 is protruded at an upper backward side of the boss 37. On the right face of the right end wall 35 of the case main body 22, a second restriction rib 40 is protruded at an upper forward side of the boss 37. On the right face of the right end wall 35 of the case main body 22, a columnar protrusion 41 is formed below the first restriction rib 38.

As shown in FIG. 4, the conveying screw 23 is formed in an elongated-shape in the left and right directions. The conveying screw 23 includes a bar-formed screw shaft 42 and a spiral fin 43 concentrically mounted on an outer circumference of the screw shaft 42. To a right end portion of the screw shaft 42, a conveying gear 44 is fixed.

The agitating paddle 24 is located at a front upper side of the conveying screw 23 and formed in an elongated-shape in the left and right directions. The agitating paddle 24 includes a frame plate-formed supporting frame 45 and a sheet-formed agitating blade 46 supported by the supporting frame 45. Both left and right ends of the supporting frame 45 are pivotally supported by a left end wall (not shown) and the right end wall 35 of the case main body 22, respectively. The agitating blade 46 is made of a synthetic resin sheet, e.g. lumirror.

On an outer circumference of the covering body 25, a covering body side flange portion 47 is formed in the correspondent shape to the main body side flange portion 30 of the case main body 22. The main body side flange portion 30 and covering body side flange portion 47 are ultrasonic-welded together so that the case main body 22 and covering body 25 are unified.

As shown in FIG. 5, the lever 26 includes a lever main body 50 with a circular profile in lateral view and a gripping portion 51 protruded from an upper portion of the lever main body 50 to the outside in a radial direction. The lever main body 50 is attached on an outer circumference of the boss 37 arranged on the right end wall 35 of the case main body 22. Thereby, the lever 26 is rotatably supported by the case main body 22. On the lever main body 50, a protrusion piece 52 is protruded to the outside in the radial direction in front of the gripping portion 51. On an outer circumference of a rear lower portion of the lever main body 50, a lever side gear 53 is formed.

The transmitting member 27 includes a disc-formed transmitting member main body 54. On a right face (an outer face) of the transmitting member main body 54, a transmission coupling 55 is protruded. The transmission coupling 55 is jointed to a drive mechanism (not shown) housed in the case member 21 so that the transmitting member 27 is rotated by drive force of the drive mechanism.

On a left face (an inner face) of the transmitting member main body 54, an insertion piece 56 is protruded. The insertion piece 56 is inserted into the communication hole 36 bored in the boss 37 of the case main body 22, and then, jointed to the supporting frame 45 of the agitating paddle 24. Accordingly, when the transmitting member 27 is rotated, this rotation is transmitted to the agitating paddle 24 to rotate the agitating paddle 24 so that the toner in the case main body 22 is agitated and conveyed to the conveying screw 23 side.

Figure 6:
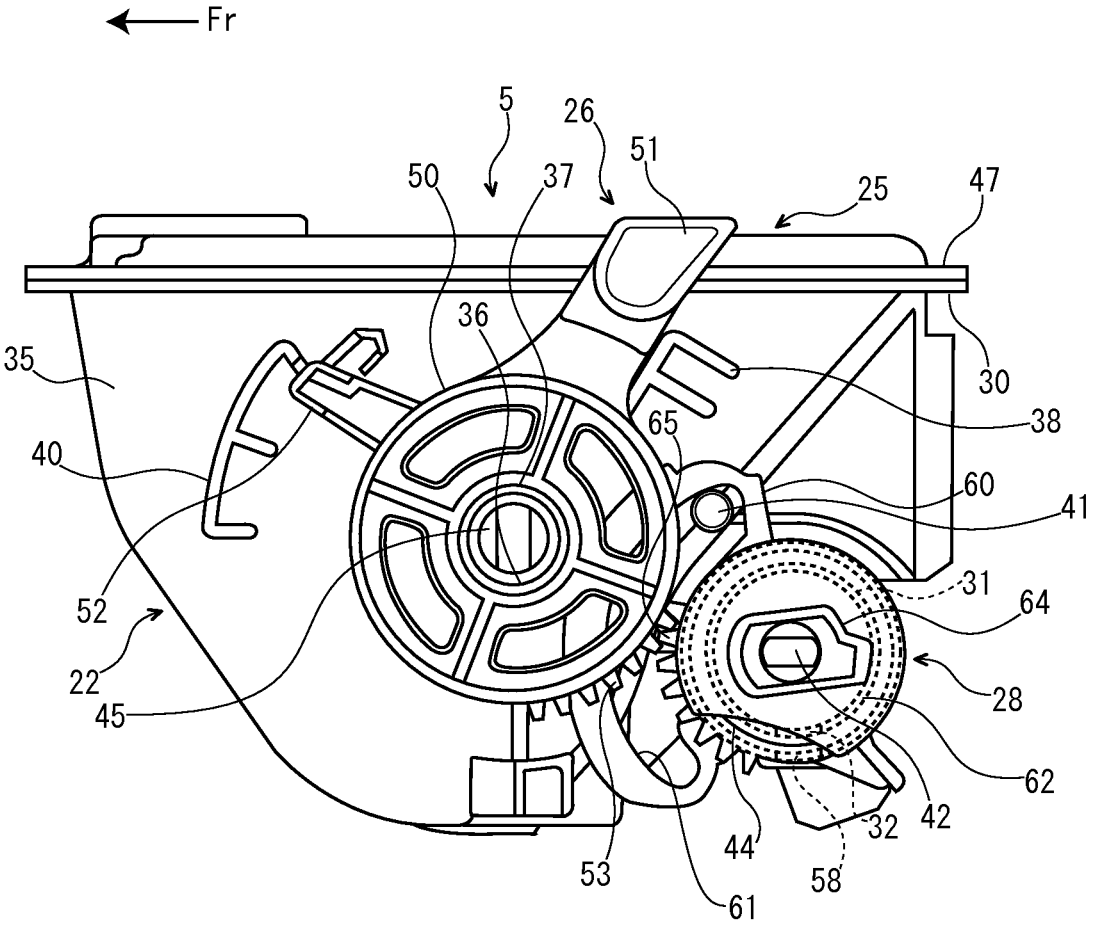
FIG. 6 is a right side view showing the toner container, in a situation where a lever is in a first position, in the printer according to the embodiment of the present disclosure.
Figure 7:
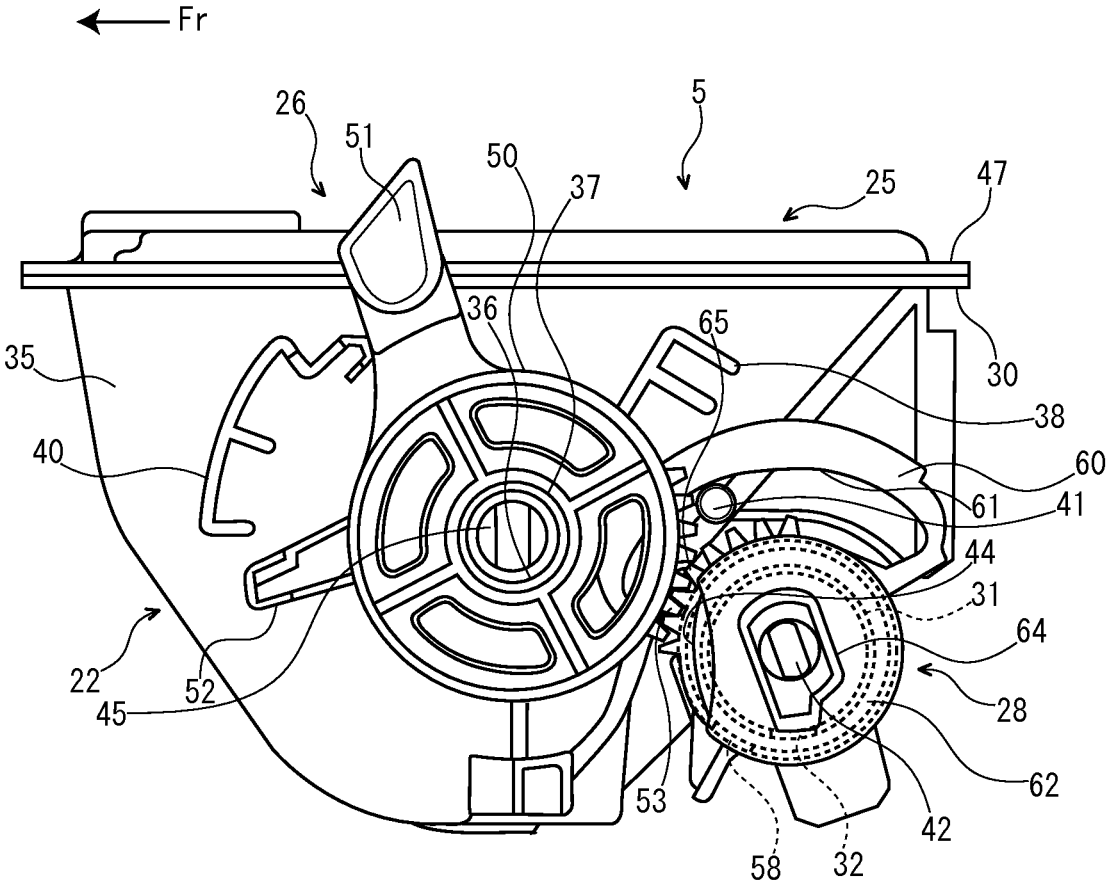
FIG. 7 is a right side view showing the toner container, in a situation where the lever is in a second position, in the printer according to the embodiment of the present disclosure.

On an outer circumference of the transmitting member main body 54, a transmission gear 57 is formed. The transmission gear 57 meshes with the conveying gear 44 fixed to the screw shaft 42 of the conveying screw 23. According to this, when the transmitting member 27 is rotated, this rotation is transmitted to the conveying screw 23 to rotate the conveying screw 23 so that the toner in the case main body 22 is discharged from the discharge port 32 and filled up into the development device 12 (refer to FIG. 1). In FIGS. 6 and 7, the transmitting member 27 is omitted.

As shown in FIG. 5, the shutter 28 is formed in a roughly cylindrical shape and rotatably installed to an outer circumference of the discharge duct 31 of the case main body 22. In a lower face of the shutter 28, a discharge aperture 58 is bored. On the shutter 28, a roughly fan-formed guiding piece 60 is protruded. In the guiding piece 60, an arc-formed guiding hole 61 is formed and, with the guiding hole 61, the protrusion 41 of the case main body 22 is engaged. In the shutter 28, a gear housing portion 62 is provided and, in the gear housing portion 62, the conveying gear 44 is housed. In the shutter 28, a locking piece 64 protruded to the right direction is provided.

As shown in FIGS. 6 and 7, in the shutter 28, a shutter side gear 65 is provided. The shutter side gear 65 meshes with the lever side gear 53 of the lever 26. Therefore, when the gripping portion 51 of the lever 26 is manipulated to rotate the lever 26, the shutter 28 is rotated in an opposite direction to the lever 26 to open/close the discharge port 32 of the case main body 22. Hereinafter, a position of the lever 26 to make the shutter 28 open the discharge port 32 of the case main body 22 (a position of the lever 26 to communicate the discharge port 32 of the case main body 22 and the discharge aperture 58 of the shutter 28) is called as a first position (refer to FIG. 6). By contrast, a position of the lever 26 to make the shutter 28 close the discharge port 32 of the case main body 22 (a position of the lever 26 to cut off the communication of the discharge port 32 of the case main body 22 and the discharge aperture 58 of the shutter 28) is called as a second position (refer to FIG. 7).

Next, the front cover 6 will be described.

Figure 2:
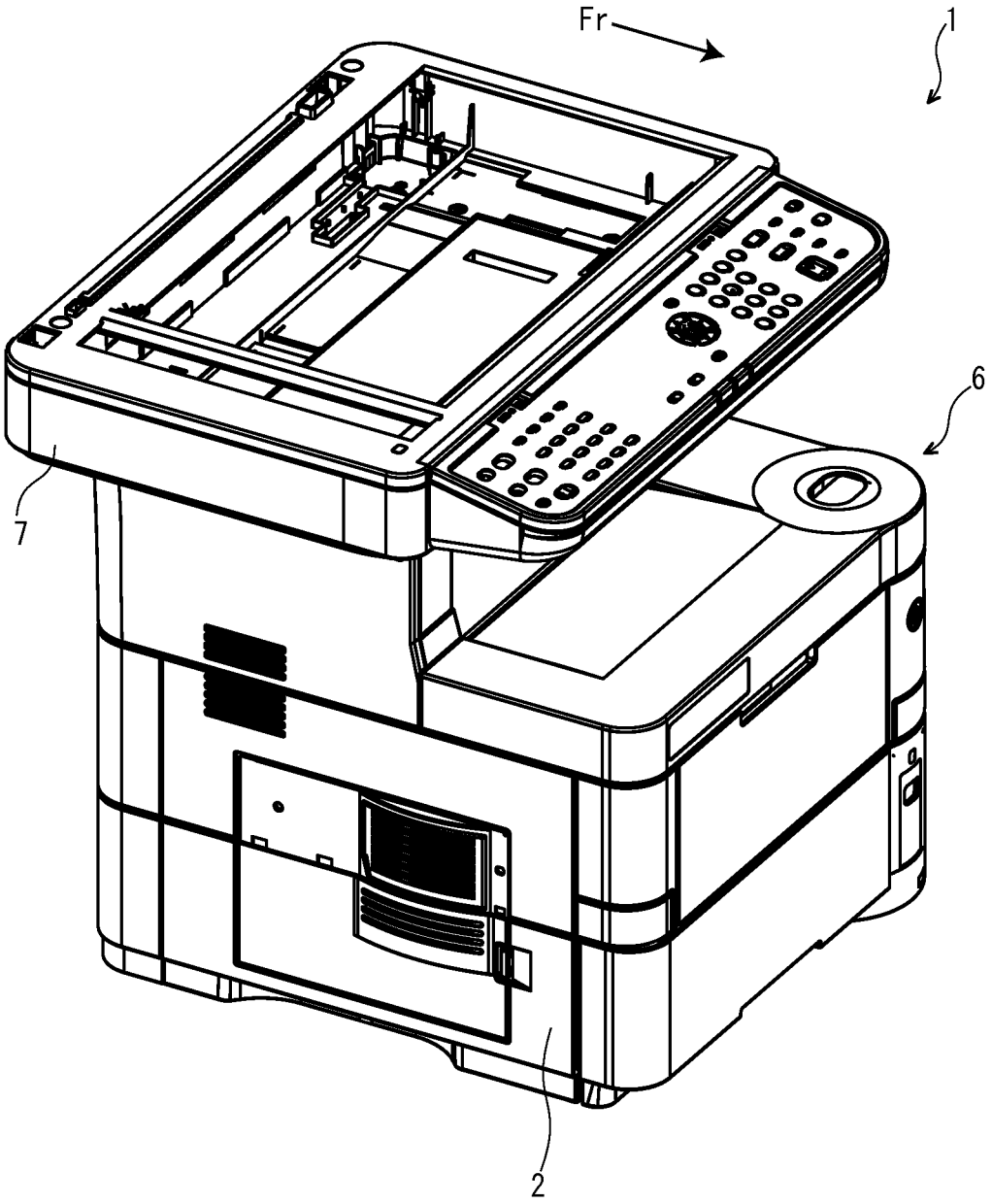
FIG. 2 is a perspective view showing the printer, in a situation where a front cover is closed, according to the embodiment of the present disclosure.

As shown in FIGS. 2 and 3, the front cover 6 is openably/closably attached to a front end portion of the printer main body 2. Hereinafter, with regard to the front cover 6, the terms indicating the respective directions, such as the upward and backward directions, left and right directions, and forward and backward directions, are defined on the basis of a state that the front cover 6 is closed (refer to FIG. 2).

Figure 8:
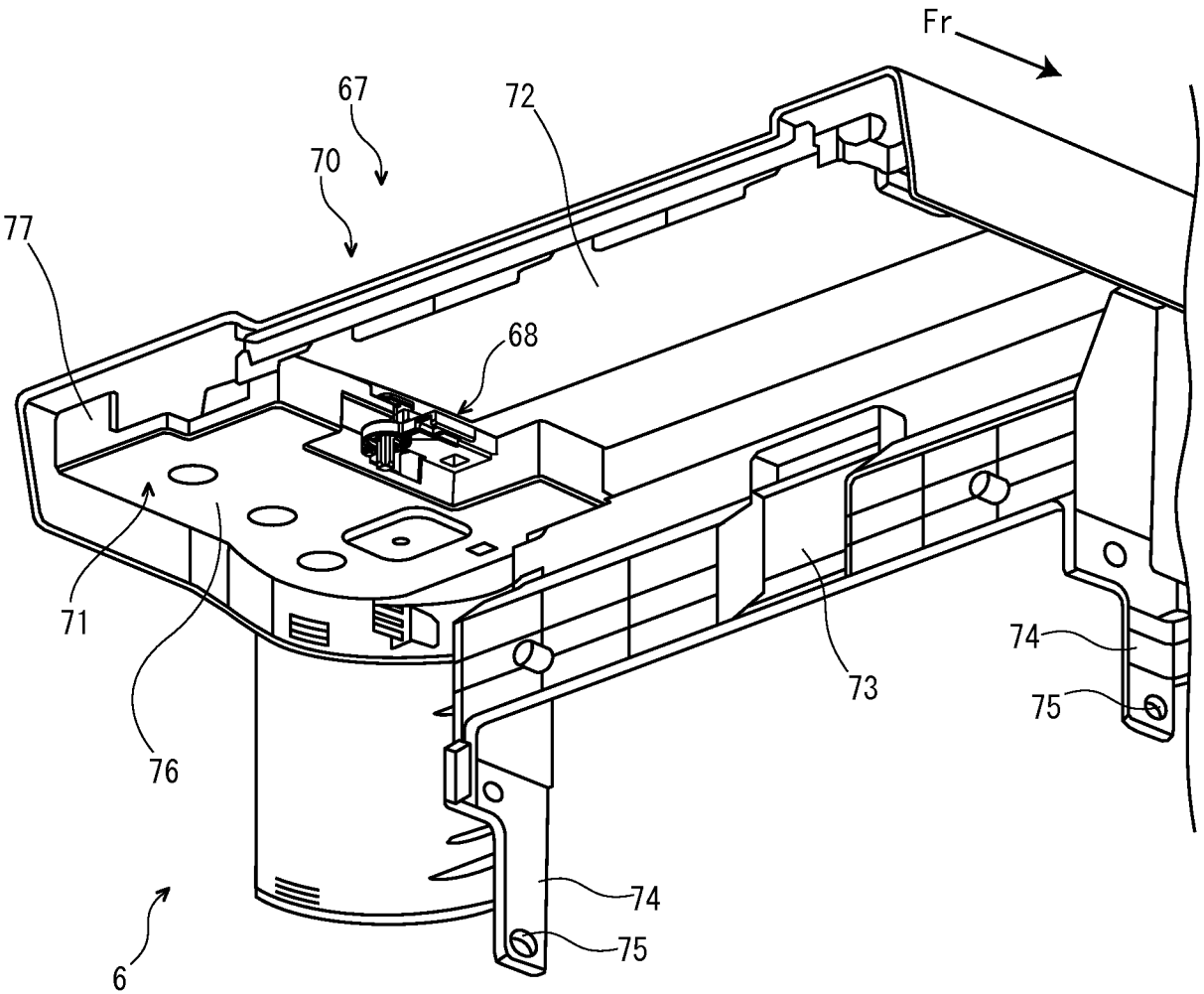
FIG. 8 is a perspective view showing the front cover of the printer according to the embodiment of the present disclosure.

As shown in FIG. 8, the front cover 6 is mainly composed of a cover main body 67 and an interfering member 68 provided at an inner face side of the cover main body 67.

The cover main body 67 includes an outer cover portion 70 exposed to the outside and an inner cover portion 71 provided at an inner face side of a right end portion (a left end portion in FIG. 8) of the outer cover portion 70.

The outer cover portion 70 has an upper wall portion 72 (a first wall portion) extending in the horizontal direction and a front wall portion 73 (a second wall portion) extending downwardly from a front end portion (one end portion) of the upper wall portion 72. In the front wall portion 73, a pair of left and right attachment plates 74 are protruded downwardly. In a lower end portion of each attachment plate 74, a fulcrum portion 75 is provided. Around the fulcrum portion 75, the front cover 6 can be rotated.

Figure 9:
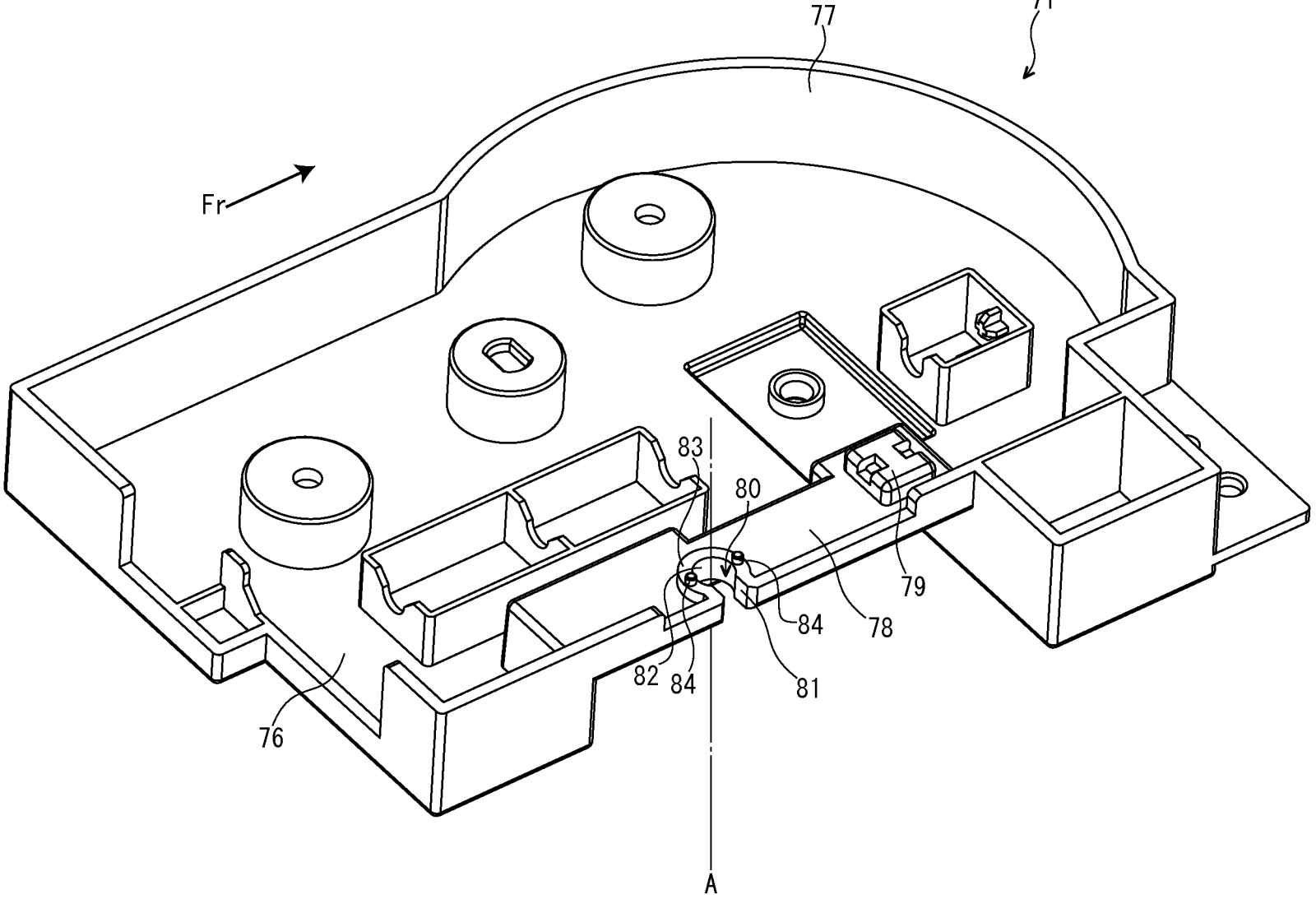
FIG. 9 is a perspective view showing an inner cover portion of a cover main body in the front cover of the printer according to the embodiment of the present disclosure.

As shown in FIG. 9, the inner cover portion 71 has a main body portion 76 extending in the horizontal direction and an outer frame portion 77 protruding upwardly from an outer circumference portion of the main body portion 76.

The main body portion 76 is parallel to the upper wall portion 72 of the outer cover portion 70. In a left end portion of the main body portion 76 of the inner cover portion 71, a supporting portion 78 protruding upwardly is provided. In a front end portion of an upper face of the supporting portion 78, a spring reception portion 79 is provided. In a rear portion of the supporting portion 78, an insertion gap 80 is formed in the upward and downward directions. The insertion gap 80 is recessed in a left edge portion of the inner cover portion 71. The insertion gap 80 has a first gap portion 81 widened in the left and right directions and a second gap portion 82 formed continuously to the first gap portion 81 at a right side (an inner side) of the first gap portion 81. The first gap portion 81 has a rectangular shape in plane view and the second gap portion 82 has a circular shape in plane view. A width in the forward and backward directions of the first gap portion 81 is smaller than a diameter of the second gap portion 82.

The outer frame portion 77 protrudes to the upper wall portion 72 of the outer cover portion 70 from an outer circumference portion of the main body portion 76. In a left end portion of the outer frame portion 77 of the inner cover portion 71, a guide frame portion 83 is provided along an outer circumference of the insertion gap 80. On an upper face of the guide frame portion 83, engagement protrusions 84 (first engagement portions) are protruded at a correspondent position to the second gap portion 82 of the insertion gap 80. Two engagement protrusions 84 are arranged around an axis line A passing through the center of the second gap portion 82 at 180 degrees intervals.

Figure 10:
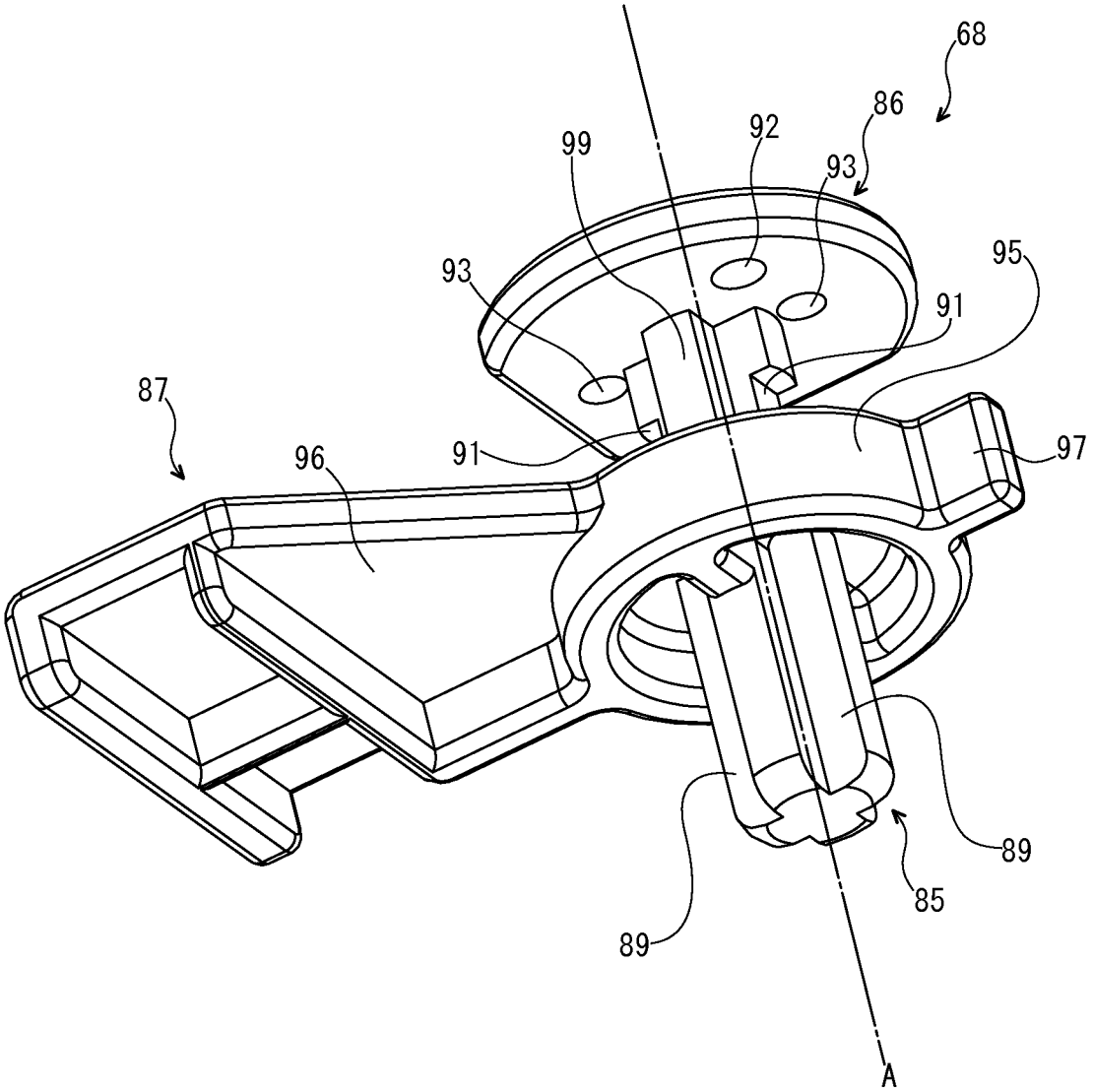
FIG. 10 is a perspective view showing an interfering member in the front cover of the printer according to the embodiment of the present disclosure.

As shown in FIG. 10, the interfering member 68 includes a rotation shaft 85 extending in the upward and downward directions, an attachment piece 86 provided on an upper end portion (one end portion in an axial direction) of the rotation shaft 85 and an interfering piece 87 provided on a center portion in the upward and backward directions (a center portion in the axial direction) of the rotation shaft 85.

On an outer circumference face of the rotation shaft 85, four V-shaped notch portions 89 extending in the upward and downward directions are formed at 90 degrees intervals. In an upper portion of the rotation shaft 85, a pair of recessed portions 91 are formed. A diameter of the rotation shaft 85 at a portion having the recessed portions 91 is smaller than the width of the first gap portion 81 of the insertion gap 80 arranged in the inner cover portion 71 of the cover main body 67.

Figure 11:
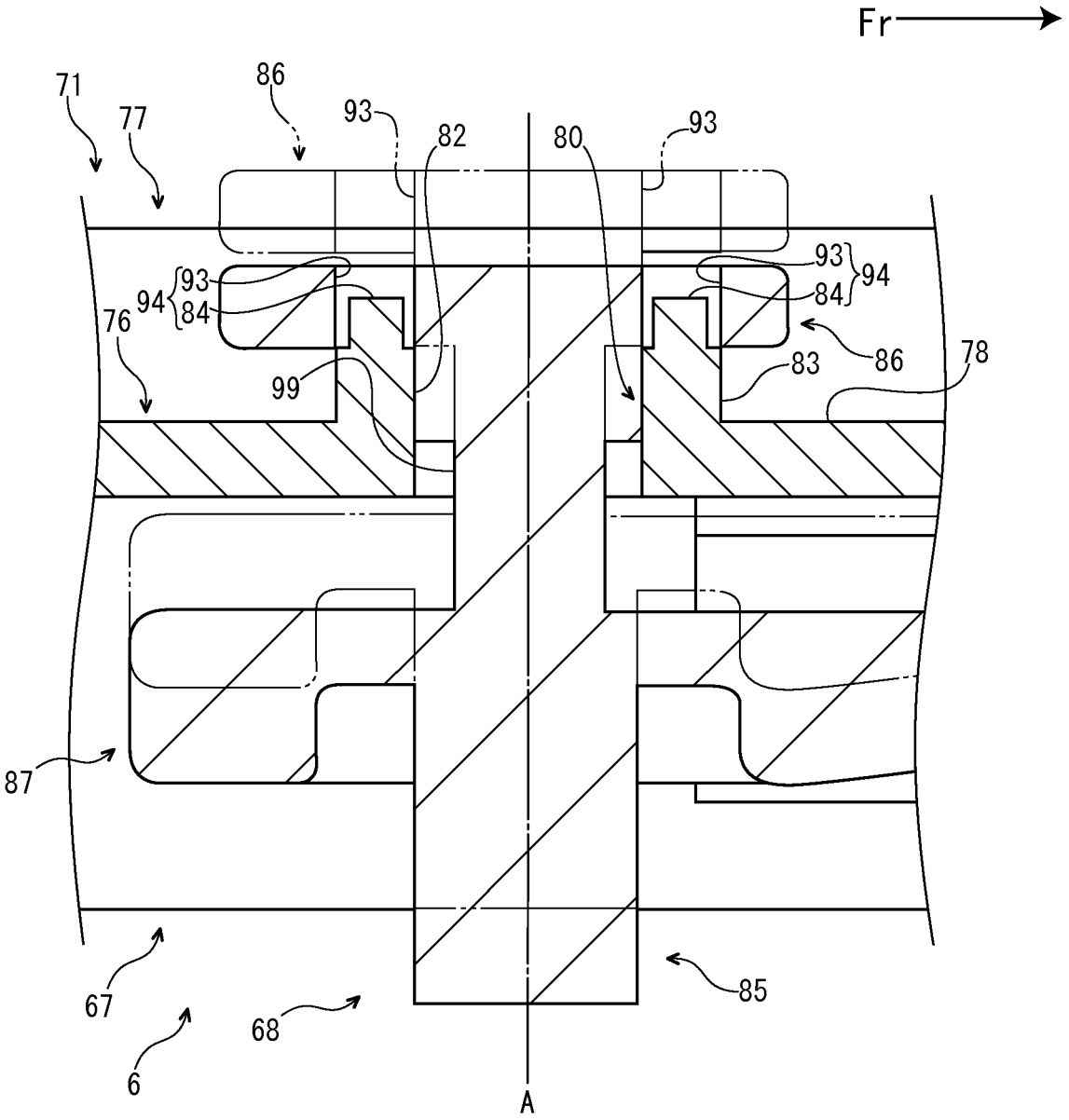
FIG. 11 is a sectional view showing the interfering member and the periphery in the front cover of the printer according to the embodiment of the present disclosure.

As shown in FIG. 11, the rotation shaft 85 has a inserted portion 99 provided between the attachment piece 86 and the interfering piece 87. The inserted portion 99 is inserted into the second gap portion 82 of the insertion gap 80 arranged in the inner cover portion 71 of the cover main body 67. That is, the rotation shaft 85 is inserted into the second gap portion 82 of the insertion gap 80 at a position between the attachment piece 86 and interfering piece 87. Thereby, between an interfering position (refer to FIG. 12) and an interference release position (refer to FIG. 13), the interfering member 68 can be rotated around the axis line A. Thus, the interfering member 68 is rotatably supported by the inner cover portion 71 of the cover main body 67.

As shown in FIG. 10, the attachment piece 86 is arranged on the outer circumference of the rotation shaft 85. The attachment piece 86 has a flat plate shape. In the attachment piece 86, a spring attachment hole 92 and engagement holes 93 (second engagement portions) are bored. Two engagement holes 93 are arranged around the above-mentioned axis line A at 180 degrees intervals. As shown in FIG. 11, each engagement hole 93 is engagable with each engagement protrusion 84 arranged in the inner cover portion 71 of the cover main body 67. Each engagement hole 93 together with each engagement protrusion 84 constitutes a holding mechanism 94.

As shown in FIG. 10, the interfering piece 87 is arranged on the outer circumference of the rotation shaft 85 at an interval from the attachment piece 86. The interfering piece 87 has an annular base portion 95 arranged coaxially to the rotation shaft 85, an extension portion 96 extending horizontally from the base portion 95 and a projection 97 projecting horizontally from the base portion 95 in an opposite direction to the extension portion 96.

Figure 12:
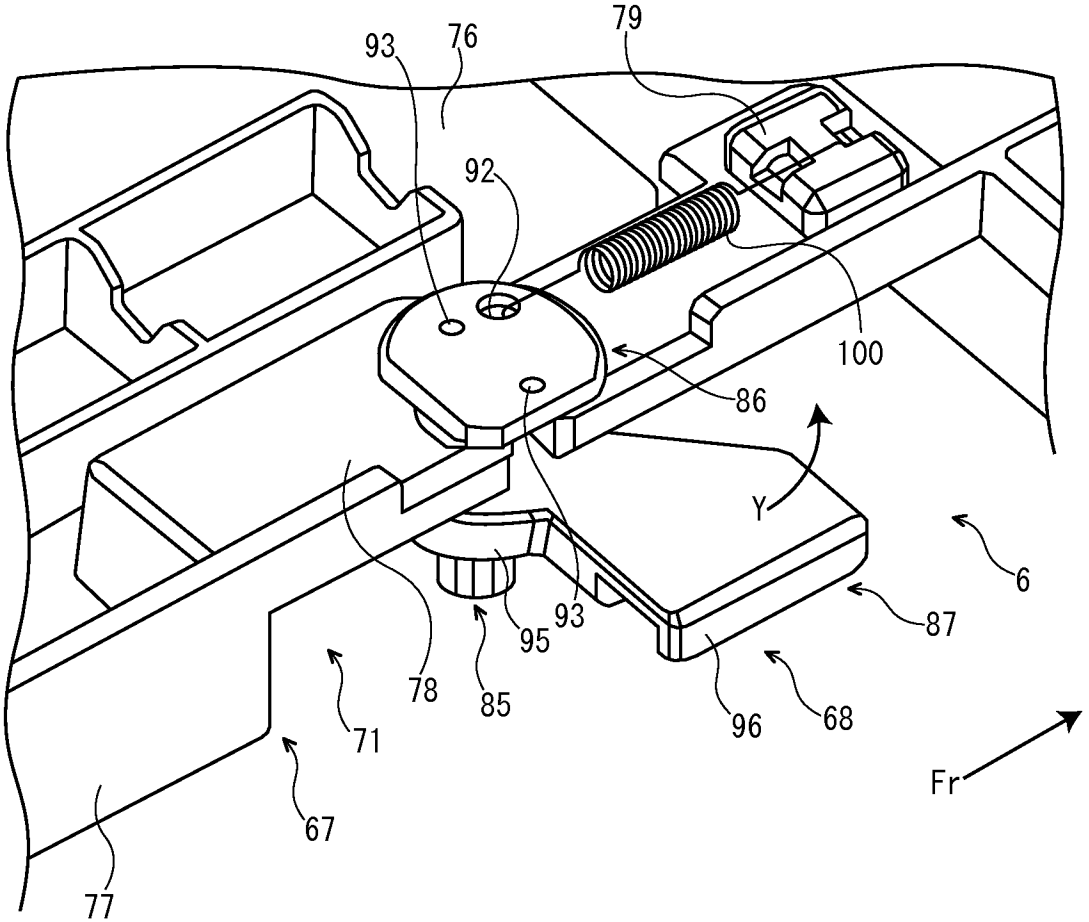
FIG. 12 is a perspective view showing the front cover, in a situation where the interfering member is in an interfering position, in the printer according to the embodiment of the present disclosure.
Figure 13:
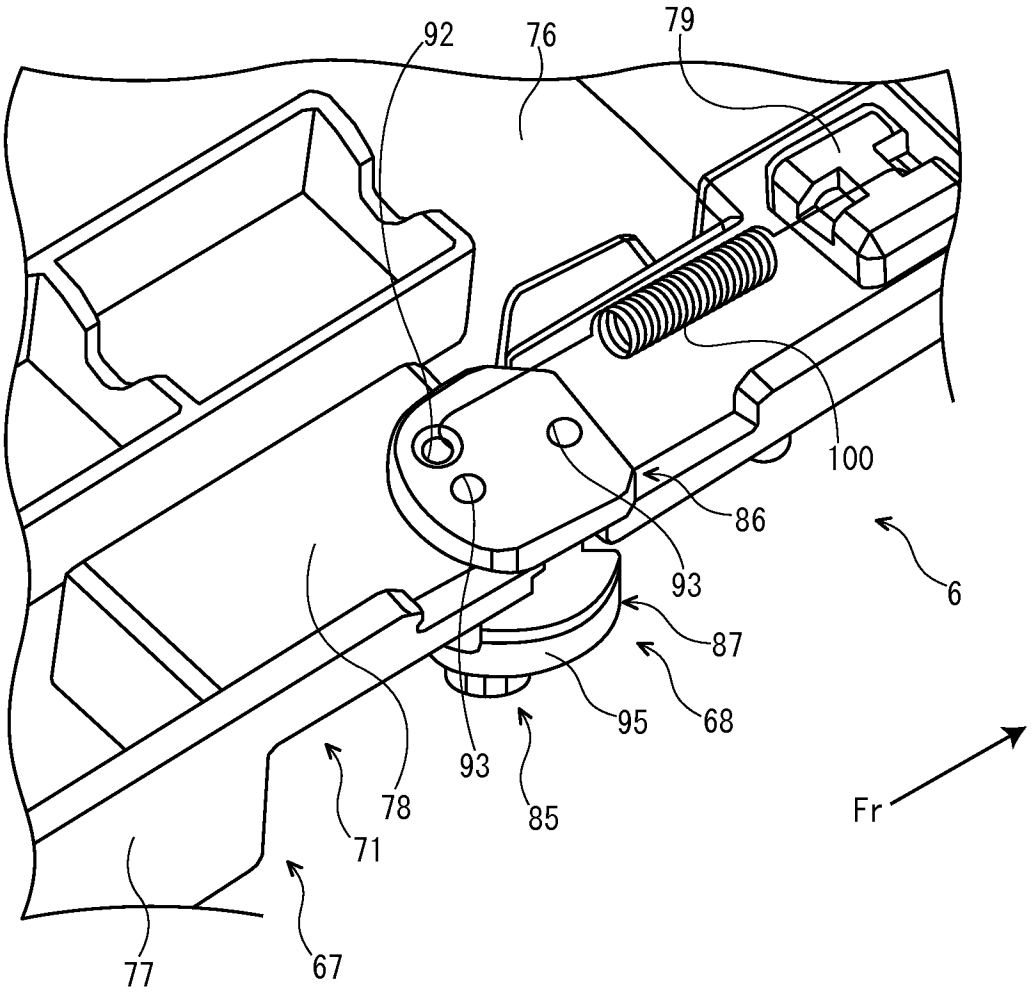
FIG. 13 is a perspective view showing the front cover, in a situation where the interfering member is in an interference release position, in the printer according to the embodiment of the present disclosure.
Figure 14:
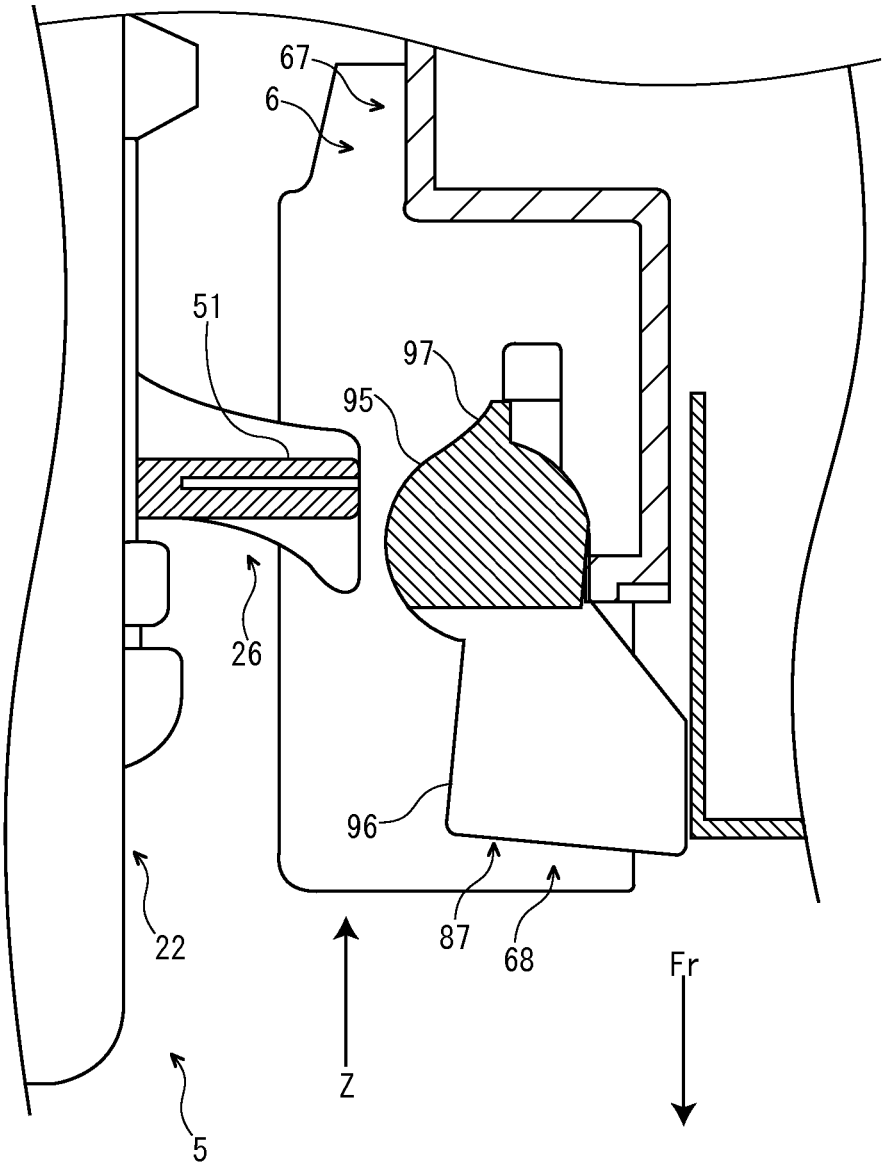
FIG. 14 is a sectional plan view showing the printer, in a situation, in the middle of closing the cover, where the interfering member is held at the interference release position, according to the embodiment of the present disclosure.

As shown in FIGS. 12 and 13, at an upper face side of the supporting portion 78 arranged in the inner cover portion 71 of the cover main body 67, a coil spring 100 (a biasing member) is located. One end portion of the coil spring 100 is attached to the spring reception portion 79 arranged on the inner cover portion 71 of the cover main body 67. Another end portion of the coil spring 100 is attached to the spring attachment hole 92 of the attachment piece 86 of the interfering member 68. That is, the coil spring 100 is interposed between the inner cover portion 71 of the cover main body 67 and the attachment piece 86 of the interfering member 68. The coil spring 100 biases the interfering member 68 to the interfering position (refer to FIG. 12).

In the printer 1 with the above-mentioned configuration, an operation opening/closing the front cover 6 in shipping and using will be described. Arrows Z in FIGS. 14, 15A, 17 and 18 indicate a closing direction of the front cover 6.

When the printer 1 is shipped, the toner container 5 is attached to the container installation portion 20 of the printer main body 2 in a situation where the lever 26 is held at the second position (refer to FIG. 7). Then, a manipulator manually presses the interfering piece 87 of the interfering member 68 of the front cover 6 forwardly and rotates, as indicated by an arrow Y in FIG. 12, the interfering member 68 of the front cover 6 from the interfering position to the interference release position against biasing force of the coil spring 100. Subsequently, the manipulator manually presses the attachment piece 86 of the interfering member 68 downwardly to engage, as shown in FIG. 11, each engagement protrusion 84 of the inner cover portion 71 of the cover main body 67 and each engagement hole 93 of the attachment piece 86 of the interfering member 68 with each other. Thereby, the holding mechanism 94 holds the interfering member 68 at the interference release position against the biasing force of the coil spring 100.

Next, the front cover 6 is closed. At that time, since the interfering member 68 is held at the interference release position as mentioned above, as shown in FIG. 14, the gripping portion 51 of the lever 26 of the toner container 5 does not interfere with the interfering piece 87 of the interfering member 68.

Figure 15A:
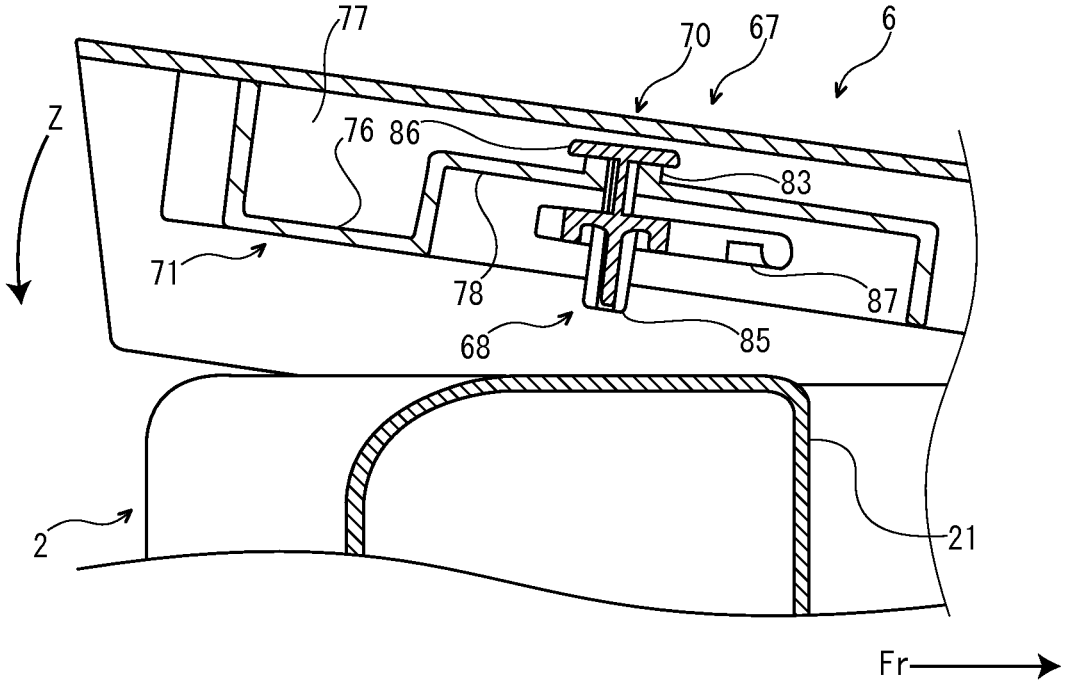
FIG. 15A is a sectional side view showing the printer, in the situation, in the middle of closing the cover, where the interfering member is held at the interference release position, according to the embodiment of the present disclosure.
Figure 15B:
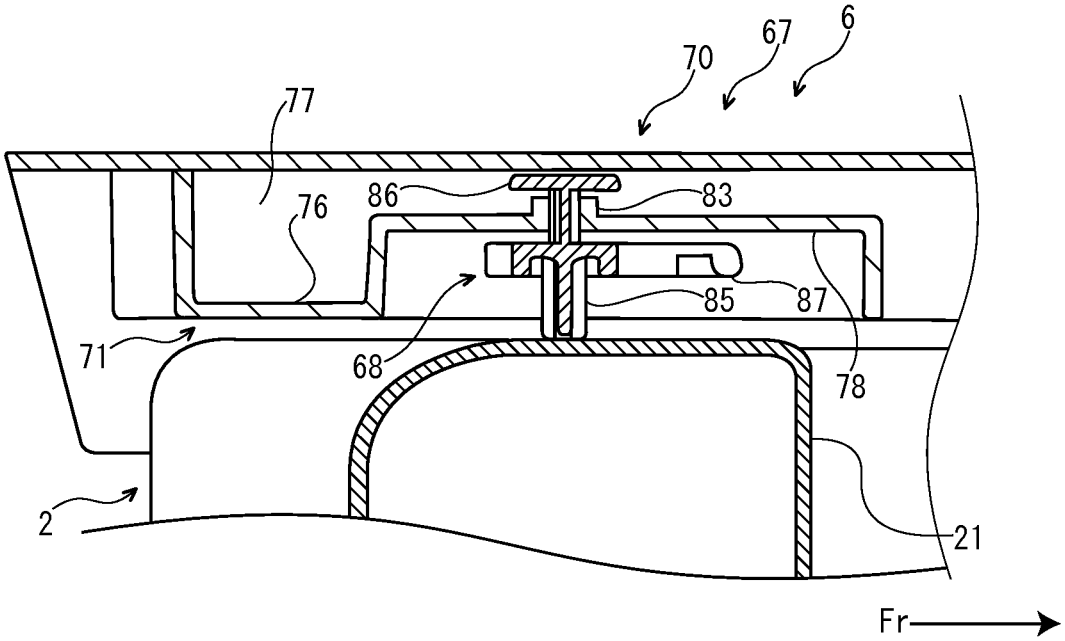
FIG. 15B is a sectional side view showing the printer, in a situation where the interfering member is held at the interference release position and the cover is closed, according to the embodiment of the present disclosure.
Figure 16:
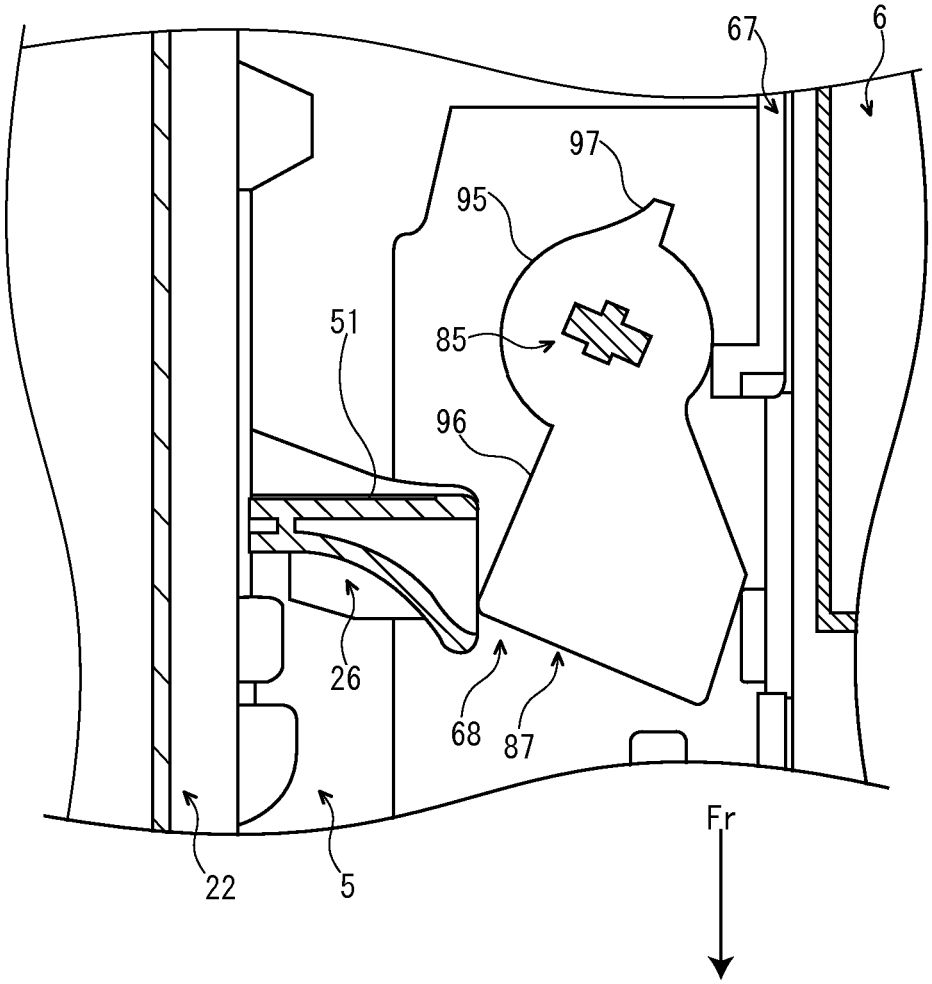
FIG. 16 is a sectional plan view showing the printer, in a situation where the interfering member is in a middle position and the cover is closed, according to the embodiment of the present disclosure.

In a situation before the front cover 6 is closed, as shown in FIG. 15A, the attachment piece 86 of the interfering member 68 comes into contact with the guide frame portion 83 of the inner cover portion 71 of the cover main body 67. By contrast, when the front cover 6 is closed, as shown in FIG. 15B, the upper face of the case member 21 of the printer main body 2 presses a lower end portion of the rotation shaft 85 of the interfering member 68, and then, the attachment piece 86 of the interfering member 68 is floated from the guide frame portion 83 of the inner cover portion 71 of the cover main body 67. According to this, as indicated by two-dot chain line in FIG. 11, the engagement of each engagement protrusion 84 of the inner cover portion 71 of the cover main body 67 and each engagement hole 93 of the attachment piece 86 of the interfering member 68 is released. Thereby, holding of the interfering member 68 at the interference release position by the holding mechanism 94 is released, and then, the interfering member 68 is rotated to a middle position between the interference release position and interfering position by the biasing force of the coil spring 100 (refer to FIG. 16). At this time, the gripping portion 51 of the lever 26 being in the second position comes into contact with the interfering piece 87 of the interfering member 68 being in the middle position, and then, rotation of the interfering member 68 from the middle position to the interfering position is restricted. That is, the middle position is a position where the holding of the interfering member 68 at the interference release position by the holding mechanism 94 is released, and the interfering member 68 rotating from the interference release position toward the interfering position comes into contact with the lever 26 being in the second position so that the rotation of the interfering member 68 is restricted and stopped.

When use of the printer 1 is started (the printer 1 is unsealed), the front cover 6 is opened in a situation where the interfering member 68 is in the middle position as mentioned above. According to this, the gripping portion 51 of the lever 26 of the toner container 5 and the interfering piece 87 of the interfering member 68 are separated from each other, and then, the interfering member 68 is rotated from the middle position to the interfering position by the biasing force of the coil spring 100. After that, when the printer 1 is used, the interfering member 68 is held at the interfering position.

Figure 17:
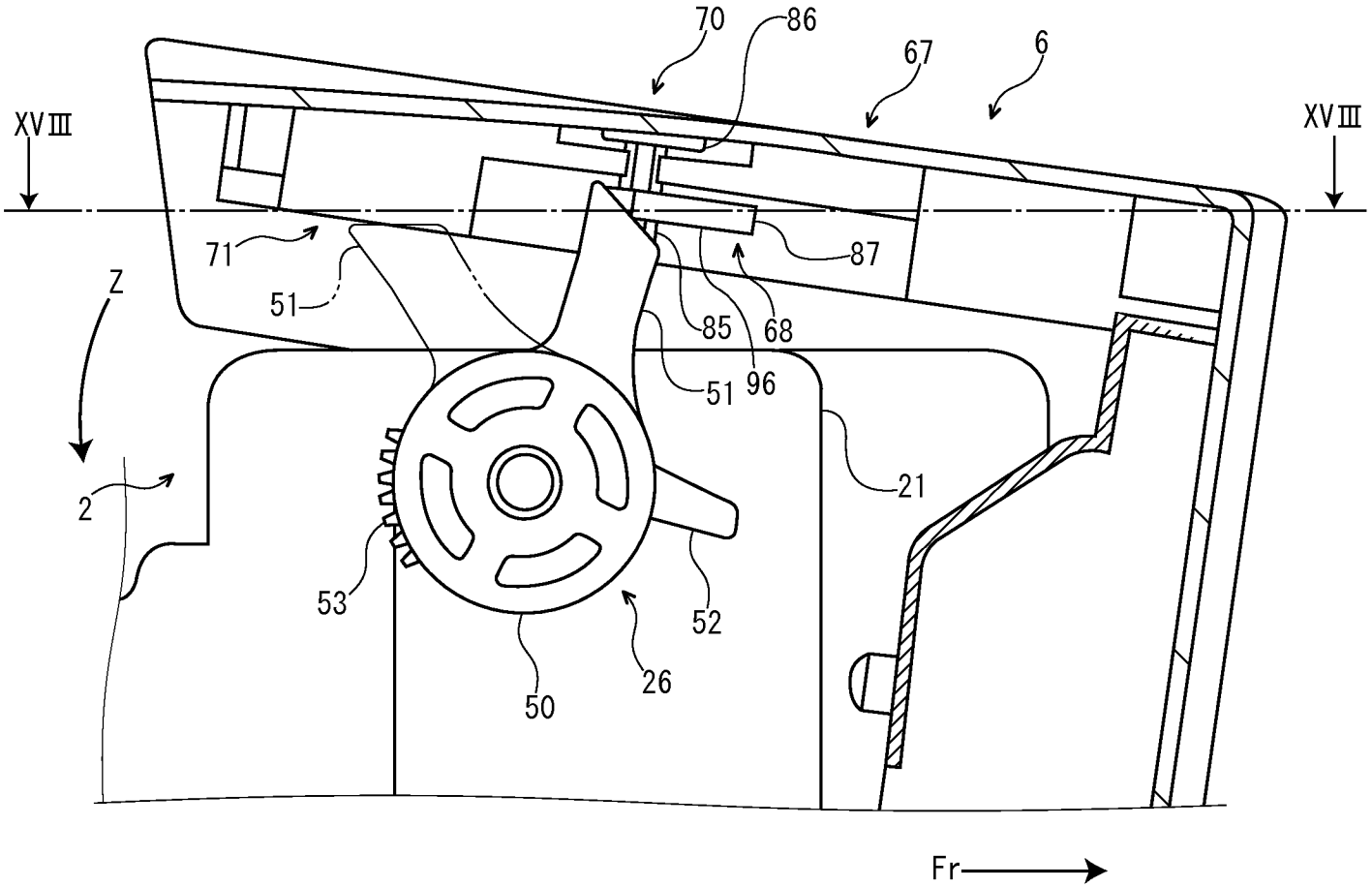
FIG. 17 is a sectional side view showing the printer, in a situation, in the middle of closing the cover, where the interfering member is held at the interfering position, according to the embodiment of the present disclosure.
Figure 18:
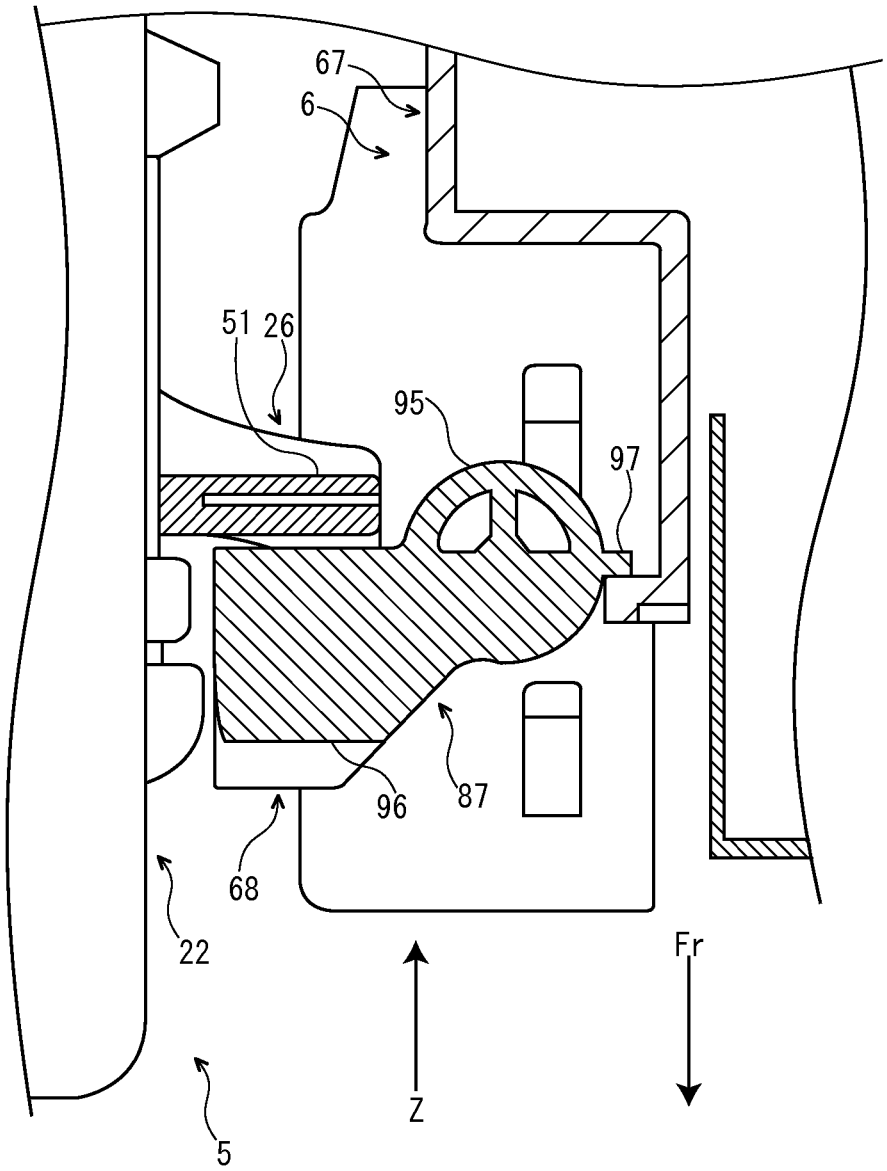
FIG. 18 is a sectional view taken along a line XVIII-XVIII of FIG. 17.

In a case where the interfering member 68 is thus in the interfering position, if close of the front cover 6 is attempted in the situation where the lever 26 of the toner container 5 is in the second position, the gripping portion 51 of the lever 26 of the toner container 5 interferes with the interfering piece 87 of the interfering member 68 as shown in FIGS. 17 and 18 and it is difficult to close the front cover 6. On the other hand, in a situation where the lever 26 of the toner container 5 is in the first position, the gripping portion 51 of the lever 26 of the toner container 5 does not interfere with the interfering piece 87 of the interfering member 68 as indicated by two-dot chain line in FIG. 17. Therefore, it is possible to close the front cover 6.

The front cover 6 of the embodiment includes the interfering member 68 rotatable between the interfering position where the interfering member 68 interferes with the lever 26 being in the second position and the interference release position where the interfering member 68 does not interfere with the lever 26 being in the second position. Therefore, by holding the interfering member 68 at the interference release position in shipping of the printer 1, it is possible to attach the toner container 5 to the container installation portion 20 of the printer main body 2 in the situation where the lever 26 is in the second position (a situation where the shutter 28 closes the discharge port 32) and to close the front cover 6. According to this, it is possible to surely prevent the toner from leaking from the case main body 22 in transit and to ship the printer 1 with packing the printer main body 2 together with the toner container 5. Thereby, it is possible to dispense the specific packing materials for the toner container 5 and to decrease a packing cost.

On the other hand, if the interfering member 68 is held at the interfering position in using of the printer 1, the toner container 5 is attached to the printer main body 2 in the situation where the lever 26 is in the second position (the situation where the shutter 28 closes the discharge port 32), and then, if the close of the front cover 6 is attempted, the interfering piece 87 of the interfering member 68 interferes with the gripping portion 51 of the lever 26. Accordingly, it is possible to notify a worker that the close of the front cover 6 is attempted by mistake while the shutter 28 closes the discharge port 32 and to prevent following erroneous operation.

When the front cover 6 is closed in the situation where the lever 26 is in the second position and the interfering member 68 is in the interference release position, the holding of the interfering member 68 at the interference release position by the holding mechanism 94 is released and the interfering member 68 is rotated to the middle position between the interference release position and interfering position by the biasing force of the coil spring 100. Moreover, when the front cover 6 is opened in the situation where the lever 26 is in the second position and the interfering member 68 is in the middle position, the interfering member 68 is rotated to the interfering position by the biasing force of the coil spring 100. By applying such a configuration, by closing and opening the front cover 6 in the situation where the interfering member 68 is in the interference release position, the interfering member 68 is automatically rotated from the interference release position to the interfering position. Therefore, it is possible to reduce a load of the worker as compared with a case of manually rotating the interfering member 68.

The holding mechanism 94 includes the engagement protrusions 84 arranged in the inner cover portion 71 of the cover main body 67 and the engagement holes 93 arranged in the attachment piece 86 of the interfering member 68 and being engagable with the engagement protrusions 84. It is configured that, when the front cover 6 is closed in the situation where the interfering member 68 is in the interference release position, the upper face of the case member 21 of the printer main body 2 presses the lower end portion of the rotation shaft 85 of the interfering member 68, and then, the engagement of the engagement protrusions 84 and engagement holes 93 is released. By applying such a configuration, it is possible to simplify the structure of the holding mechanism 94.

A plurality of the engagement protrusions 84 (two engagement protrusions 84 in the embodiment) and a plurality of the engagement holes 93 (two engagement holes 93 in the embodiment) are arranged around the above-mentioned axis line A as a rotation center of the interfering member 68 at equal angular intervals (180 degrees intervals in the embodiment). By applying such a configuration, it is possible to surely hold the interfering member 68 at the interference release position by the holding mechanism 94.

The interfering member 68 includes the rotation shaft 85, the attachment piece 86 to which the coil spring 100 is attached, the attachment piece 86 arranged on the outer circumference of the rotation shaft 85, and the interfering piece 87 arranged on the outer circumference of the rotation shaft 85 at the interval from the attachment piece 86 and interfering with the gripping portion 51 of the lever 26. By applying such a configuration, it is possible to simplify the structure of the interfering member 68.

In the left edge portion of the inner cover portion 71 of the cover main body 67, the insertion gap 80 is recessed and, between the attachment piece 86 and interfering piece 87, the rotation shaft 85 is inserted into the second gap portion 82 of the insertion gap 80. By applying such a configuration, it is possible to easily attach the interfering member 68 to the cover main body 67.

The cover main body 67 includes the outer cover portion 70 exposed to the outside and the inner cover portion 71 arranged at the inner face side of the outer cover portion 70, and then, the interfering member 68 is rotatably supported by the inner cover portion 71. By applying such a configuration, it is possible to restrain the interfering member 68 from being seen from the outside as possible and to improve external appearance of the printer 1.

In the situation where the front cover 6 is closed, the lever 26 is in the second position and the interfering member 68 is in the middle position, the lever 26 comes into contact with the interfering member 68 and the rotation of the interfering member 68 from the middle position to the interfering position is restricted. By applying such a configuration, it is possible to easily restrict the rotation of the interfering member 68 from the middle position to the interfering position.

Although, in the embodiment, the engagement protrusions 84 are arranged as the first engagement portions and the engagement holes 93 are arranged as the second engagement portion, in another embodiment, an engagement hole may be arranged as a first engagement portion and an engagement protrusion may be arranged as a second engagement portion.

Although, in the embodiment, a case of arranging the coil spring 100 as the biasing member was described, in another embodiment, a torsion coil spring may be arranged as the biasing member.

Although, in the embodiment, a case of automatically rotating the interfering member 68 from the interference release position to the interfering position by closing and opening the front cover 6 was described, in another embodiment, the interfering member 68 may be manually rotated from the interference release position to the interfering position.

Although, in the embodiment, a case of rotating the interfering member 68 was described, in another embodiment, the interfering member 68 may be slid linearly.

Although, in the embodiment, a case of applying the configuration of the present disclosure to the front cover 6 was described, in another embodiment, the configuration of the present disclosure may be applied to a rear cover, a side face cover or other.

Although, in the embodiment, a case of forming individually the lever 26 and shutter 28 was described, in another embodiment, the lever 26 and shutter 28 may be formed in a body.

Although the embodiment was described in a case of applying the configuration of the present disclosure to the printer 1, in another embodiment, the configuration of the present disclosure may be applied to another image forming apparatus except for the printer 1, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a toner case including a case main body having a discharge port configured to discharge a toner, a shutter configured to open/close the discharge port, and a manipulation portion movable between a first position to make the shutter open the discharge port and a second position to make the shutter close the discharge port;

an apparatus main body to which the toner case is detachably attached; and a cover openably/closably attached to the apparatus main body, wherein the cover includes an interfering member movable between an interfering position where the interfering member interferes with the manipulation portion being in the second position and an interference release position where the interfering member does not interfere with the manipulation portion being in the second position.

2. The image forming apparatus according to claim 1, wherein the cover further includes:

a cover main body configured to rotatably support the interfering member;

a biasing member configured to bias the interfering member to the interfering position; and a holding mechanism configured to hold the interfering member at the interference release position against biasing force of the biasing member, when the cover is closed in a situation where the manipulation portion is in the second position and the interfering member is in the interference release position, holding of the interfering member at the interference release position by the holding mechanism is released and the interfering member is rotated from the interference release position to a middle position between the interference release position and the interfering position by the biasing force of the biasing member, when the cover is opened in a situation where the manipulation portion is in the second position and the interfering member is in the middle position, the interfering member is rotated from the middle position to the interfering position by the biasing force of the biasing member.

3. The image forming apparatus according to claim 2, wherein the middle position is a position where the holding of the interfering member at the interference release position by the holding mechanism is released, and the interfering member rotating from the interference release position toward the interfering position comes into contact with the manipulation portion being in the second position so that the rotation of the interfering member is restricted and stopped.

4. The image forming apparatus according to claim 2, wherein the holding mechanism includes:

a first engagement portion arranged in the cover main body; and a second engagement portion arranged in the interfering member and being engagable with the first engagement portion, when the cover is closed in a situation where the interfering member is in the interference release position, the apparatus main body presses the interfering member and the engagement of the first engagement portion and the second engagement portion is released.

5. The image forming apparatus according to claim 4, wherein a plurality of the first engagement portions and a plurality of the second engagement portions are arranged around a rotation center of the interfering member at equal angular intervals.

6. The image forming apparatus according to claim 2, wherein the interfering member includes:

a rotation shaft;

an attachment piece to which the biasing member is attached, the attachment piece arranged on the outer circumference of the rotation shaft; and an interfering piece arranged on the outer circumference of the rotation shaft at an interval from the attachment piece and configured to interfere with the manipulation portion.

7. The image forming apparatus according to claim 6, wherein an insertion gap is recessed in an edge portion of the cover main body, the rotation shaft has a inserted portion which is provided between the attachment piece and the interfering piece and inserted into the insertion gap.

8. The image forming apparatus according to claim 2, wherein the cover main body includes:

an outer cover portion exposed to the outside; and an inner cover portion arranged at an inner face side of the outer cover portion, the interfering member is rotatably supported by the inner cover portion.

9. The image forming apparatus according to claim 8, wherein the outer cover portion includes:

a first wall portion configured to extend in a horizontal direction; and a second wall portion configured to extend downwardly from one end portion of the first wall portion, the cover is rotated around a lower end portion of the second wall portion.

10. The image forming apparatus according to claim 9, wherein the inner cover portion includes:

a main body portion being parallel to the first wall portion; and an outer frame portion configured to protrude to the first wall portion from an outer circumference portion of the main body portion.

* * * * *